US010309355B2

(12) United States Patent
Ozaki

(10) Patent No.: US 10,309,355 B2
(45) Date of Patent: Jun. 4, 2019

(54) SADDLE-RIDE TYPE VEHICLE

(71) Applicant: HONDA MOTOR CO., LTD., Tokyo (JP)

(72) Inventor: Yoshinobu Ozaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/469,883

(22) Filed: Mar. 27, 2017

(65) Prior Publication Data

US 2017/0284350 A1 Oct. 5, 2017

(30) Foreign Application Priority Data

Mar. 30, 2016 (JP) ..... 2016-067379

(51) Int. Cl.
*F02M 35/16* (2006.01)
*F02M 35/14* (2006.01)
*F02M 35/12* (2006.01)

(52) U.S. Cl.
CPC ..... *F02M 35/162* (2013.01); *F02M 35/14* (2013.01); *F02M 35/1255* (2013.01)

(58) Field of Classification Search
CPC ... F02M 35/162; F02M 35/14; F02M 35/1255
See application file for complete search history.

(56) References Cited

U.S. PATENT DOCUMENTS

2003/0159587 A1* 8/2003 Letourneau ..... B01D 46/0004 96/388
2012/0060799 A1* 3/2012 Wakabayashi ..... F02M 37/007 123/495
2012/0145470 A1 6/2012 Fujiyama
2013/0306393 A1* 11/2013 Yamaguchi ..... F02M 35/1255 180/291
2015/0083511 A1* 3/2015 Kono ..... B62J 35/00 180/227

FOREIGN PATENT DOCUMENTS

JP 3685220 B2 8/2005
JP 2011-47294 A 3/2011

* cited by examiner

*Primary Examiner* — Jacob M Amick
*Assistant Examiner* — Charles Brauch
(74) *Attorney, Agent, or Firm* — Birch, Stewart, Kolasch & Birch, LLP

(57) ABSTRACT

In a saddle-ride type vehicle in which an intake device is arranged at a position covered by a fuel tank from above, the intake device including: an air cleaner; a connecting tube having an upstream end thereof connected to the air cleaner; a throttle device including a throttle valve and connected to a downstream end of the connecting tube; and a resonator, a curved portion bulged upward and curved in a chevron shape is formed in the connecting tube, and the resonator arranged between the fuel tank and the connecting tube is connected to the connecting tube on the air cleaner side further than a top portion of the curved portion as seen in a side view of the vehicle.

16 Claims, 6 Drawing Sheets

SADDLE-RIDE TYPE VEHICLE

BACKGROUND OF THE INVENTION

Field of the Invention

The present invention relates to a saddle-ride type vehicle in which a fuel tank and an engine body arranged in a lower side of the fuel tank are mounted to a body frame, and an intake device is arranged at a position covered by the fuel tank from above, the intake device including: an air cleaner; a connecting tube; a throttle device; and a resonator, an upstream end of the connecting tube being connected to the air cleaner, the throttle device including a throttle valve and being connected to a downstream end of the connecting tube.

Description of the Related Art

It is well-known in Japanese Patent No. 3685220 a two-wheeled motor vehicle in which a resonator is connected to an intake pipe arranged between a throttle body as a throttle device and an engine body. Further, it is well-known in Japanese Patent Application Laid-Open No. 2011-47294 a two-wheeled motor vehicle in which the resonator is connected to a connecting tube arranged between a throttle body and an air cleaner.

However, in the two-wheeled motor vehicle disclosed in the above Japanese Patent No. 3685220, since a connection portion of the resonator to the intake pipe positions near an intake port, it is necessary to further enhance measures for disorder of mixture ratio occurring due to fuel gas staying within the resonator corresponding to blow-back of intake, measures for backfire, measures for radiant heat from the engine body, measures for noise in the air cleaner positioned at an upstream portion of the intake device, and the like. On the other hand, in the two-wheeled motor vehicle disclosed in the above Japanese Patent Application Laid-Open No. 2011-47294, although the above problems do not occur, there is a problem that fuel, water or the like condensed within the resonator invades in the throttle device during non-use time of the vehicle after an engine is stopped and easily attaches to a throttle valve.

SUMMARY OF THE INVENTION

The present invention has been achieved in view of the above-mentioned circumstances, and it is an object thereof to provide a saddle-ride type vehicle which can prevent that fuel, water or the like condensed within a resonator invades in a throttle device during non-use time of the vehicle after an engine is stopped.

In order to achieve the object, according to a first feature of the present invention, there is provided a saddle-ride type vehicle in which a fuel tank and an engine body arranged in a lower side of the fuel tank are mounted to a body frame, and an intake device is arranged at a position covered by the fuel tank from above, the intake device including: an air cleaner; a connecting tube; a throttle device; and a resonator, an upstream end of the connecting tube being connected to the air cleaner, the throttle device including a throttle valve and being connected to a downstream end of the connecting tube, wherein a curved portion bulged upward and curved in a chevron shape is formed in the connecting tube, and the resonator arranged between the fuel tank and the connecting tube is connected to the connecting tube on the air cleaner side further than a top portion of the curved portion as seen in a side view of the vehicle.

With the first feature, since the resonator is arranged between the fuel tank and the connecting tube, capacity of the resonator can be secured while avoiding that rear portion of the fuel tank becomes higher. Further, as seen in the side view of the vehicle, since the resonator is connected to the connecting tube on the air cleaner side further than the top portion of curved portion with a chevron shape formed in the connecting tube, fuel, water or the like condensed within the resonator flows to the air cleaner side even though such fuel, water or the like drops on the connecting tube side during non-use time of the vehicle after the engine is stopped, thereby it can be prevented that such fuel, water or the like invades in the throttle device.

According to a second feature of the present invention, in addition to the first feature, a recess portion receiving a part of the resonator is formed in a rear portion of a bottom plate in the fuel tank, and an upstream end of the connecting tube is arranged in a cleaner case of the air cleaner so as to overlap with a rear end of the fuel tank as seen in a plan view.

With the second feature, since a part of the resonator is received in the recess portion formed in the rear portion of the bottom plate in the fuel tank, and the upstream end of the connecting tube with a chevron shape is arranged in the cleaner case so as to overlap with the rear end of the fuel tank as seen in the plan view, the height of the rear portion of the fuel tank can be further lowered.

According to a third feature of the present invention, in addition to the second feature, a rear portion of the resonator along a front-rear direction of the vehicle is arranged so as to overlap with a front portion of the cleaner case along the front-rear direction of the vehicle as seen in the plan view.

With the third feature, the resonator is flattened so that the rear portion of the resonator overlaps with the front portion of the cleaner case as seen in the plan view, therefore capacity of the resonator can be secured while restraining that the rear portion of the fuel tank becomes high.

According to a fourth feature of the present invention, in addition to the second feature or the third feature, a fuel pump is attached to the bottom plate of the fuel tank with a lower portion of the fuel pump being protruded downward from the bottom plate, and the resonator is arranged on a rear side of the lower portion of the fuel pump along the front-rear direction of the vehicle as seen in the side view of the vehicle.

With the fourth feature, the resonator is arranged on the rear side in the front-rear direction of the vehicle of the lower portion of the fuel pump attached to the bottom plate of the fuel tank, thereby the resonator can be arranged while effectively utilizing a space around the lower portion of the fuel pump.

According to a fifth feature of the present invention, in addition to any one of the second feature to the fourth feature, a connecting portion of the resonator to the connecting tube is arranged on one of right and left sides from the top portion of the curved portion, and an air hose extended in the front-rear direction of the vehicle from the cleaner case is arranged so as to pass above the connecting tube on an other of the right and left sides of the top portion of the curved portion.

With the fifth feature, the connecting portion of the resonator to the connecting tube is arranged at the position eccentric to one of the right and left sides of the top portion of the curved portion. Thereby, path length between the resonator and the connecting tube can be secured while restraining that the rear portion of the fuel tank becomes high. Furthermore, since the air hose extended in the front-rear direction of the vehicle from the cleaner case is passed above the connecting tube on the other of the right and left sides of the top portion of the curved portion, arrangement of the air hose can be smoothly conducted.

According to a sixth feature of the present invention, in addition to any one of the second feature to the fifth feature, a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

With the sixth feature, since the cleaner element of the air cleaner is arranged so as to be separated rearward in the front-rear direction of the vehicle from the upstream end of the connecting tube and so that the circulation direction of the air extends along the front-rear direction of the vehicle, it is possible to contribute to reduction of the seat height by restraining the height of the air cleaner while securing a space between the connecting tube and the cleaner element.

The above and other objects, characteristics and advantages of the present invention will be clear from detailed descriptions of the preferred embodiment which will be provided below while referring to the attached drawings.

DESCRIPTION OF THE PREFERRED EMBODIMENT

Hereinafter, an embodiment of the present invention will be described with reference to FIGS. 1 to 6. Here, in description hereinafter, front and rear, up and down, and right and left are directions when viewed by an occupant riding on a two-wheeled motor vehicle.

Figure 1:
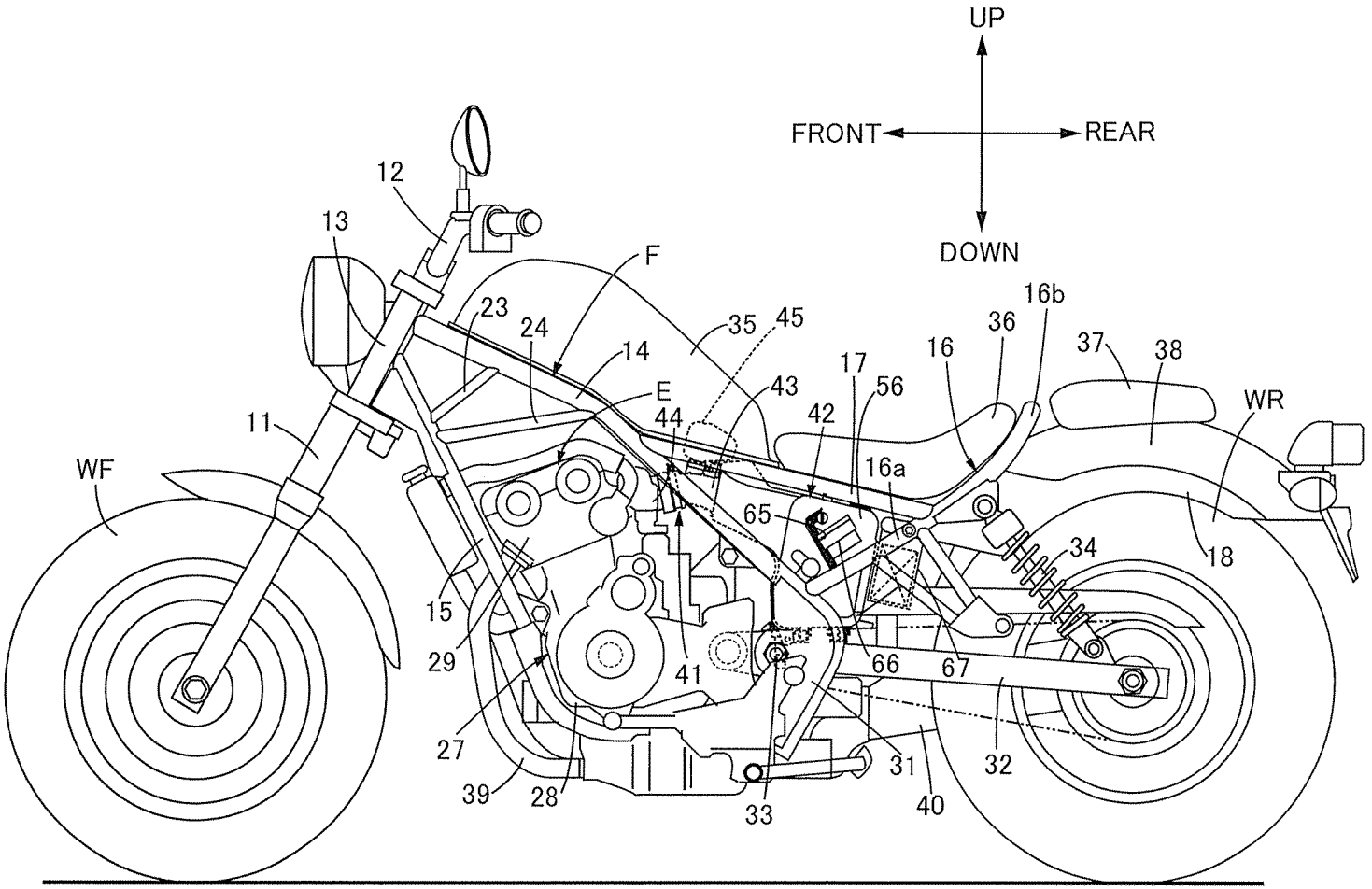
FIG. 1 is a left side view of a two-wheeled motor vehicle.
Figure 2:
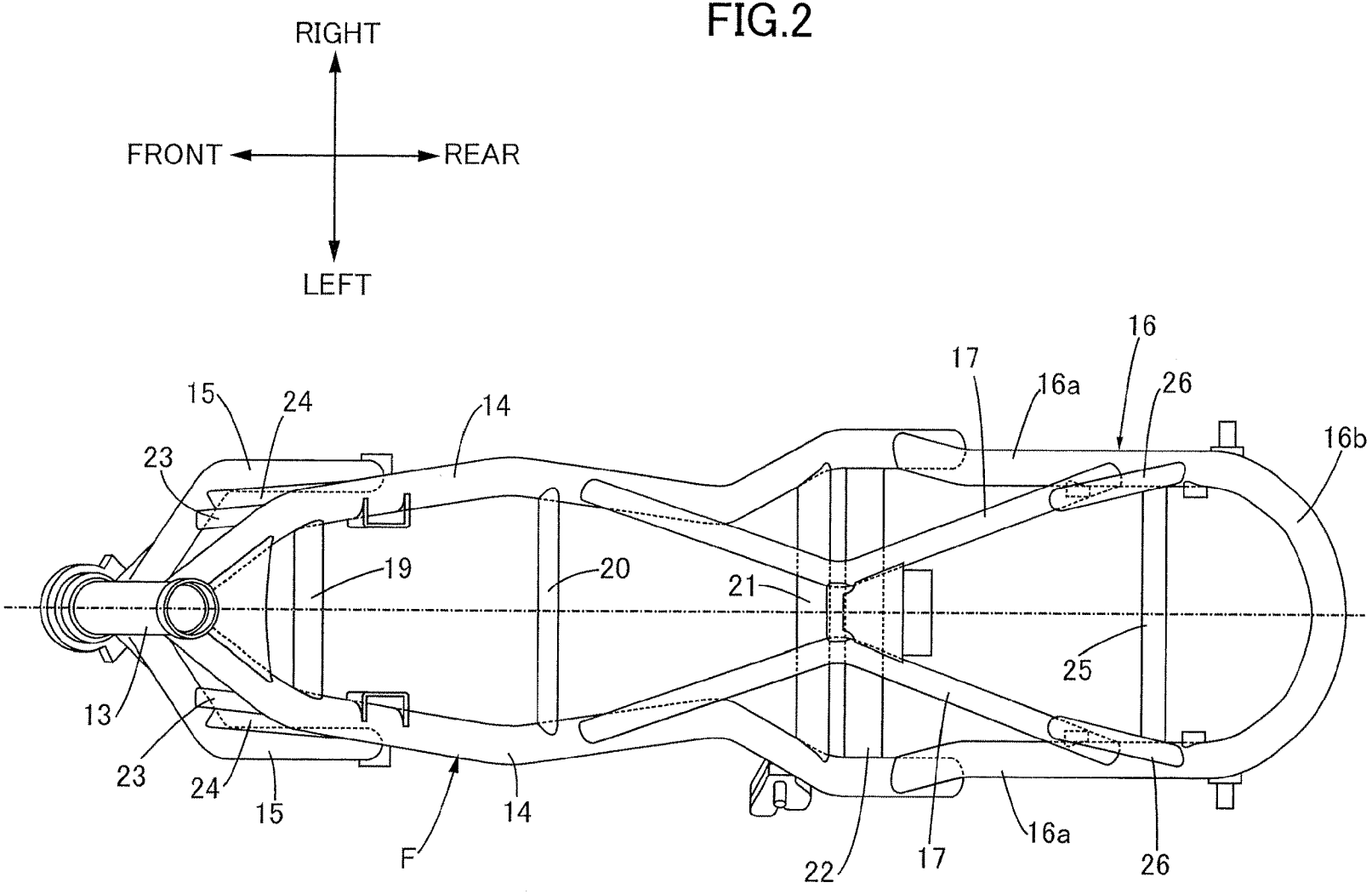
FIG. 2 is a plan view of a body frame except rear frames.

First, in FIGS. 1 and 2, a body frame F of the two-wheeled motor vehicle which is a saddle-ride type vehicle includes a head pipe 13, a pair of right and left main frames 14, a pair of right and left down frames 15, a seat frame 16, a pair of right and left seat sub-frames 17, and a pair of right and left rear frames 18. The head pipe 13 steerably supports a steering handlebar 12 and a front fork 11 pivotally supporting a front wheel FW. The pair of right and left main frames 14 are connected to the upper portion of the head pipe 13 and are extended downwardly toward the rear. The pair of right and left down frames 15 are connected to the lower portion of the head pipe 13 and are extended downwardly toward the rear at a steeper angle than the main frames 14. The seat frame 16 is configured in such a manner that front ends of a pair of right and left side pipes 16*a* are respectively connected to the lower portions of the pair of right and left main frames 14 and rear ends of the side pipes 16*a* extended upwardly toward the rear are integrally connected by a connection pipe 16*b* with a substantially C-shape, the connection pipe 16*b* being opened toward the front and obliquely downward in the front-rear direction of the vehicle. The pair of right and left seat sub-frames 17 are configured in such a manner that front end portions of the seat sub-frames 17 are connected to the intermediate portions of the pair of right and left main frames 14 along the front-rear direction of the vehicle and gradually inclined downwardly toward the rear, and rear end portions of the seat sub-frames 17 are connected to the intermediate portions, in the front-rear direction of the vehicle, of the side pipes 16*a* of the seat frame 16. The pair of right and left rear frames 18 are connected to the seat frame 16 and are extended toward the rear.

Between the pair of right and left main frames 14, first, second, third and fourth cross frames 19, 20, 21, 22 are provided at intervals in order from the front side along the front-rear direction of the vehicle. A reinforcement frame 23 and a reinforcement frame 24 are respectively provided between two positions on the main frame 14 separated from each other in the front-rear direction and two positions on the down frame 15 separated from each other in the front-rear direction. Further, between the pair of right and left side pipes 16*a* in the seat frame 16, a fifth cross frame 25 is provided and reinforcement frames 26 are respectively formed between the rear portions of the seat sub-frames 17 and the rear portions of the side pipes 16*a*.

Figure 3:
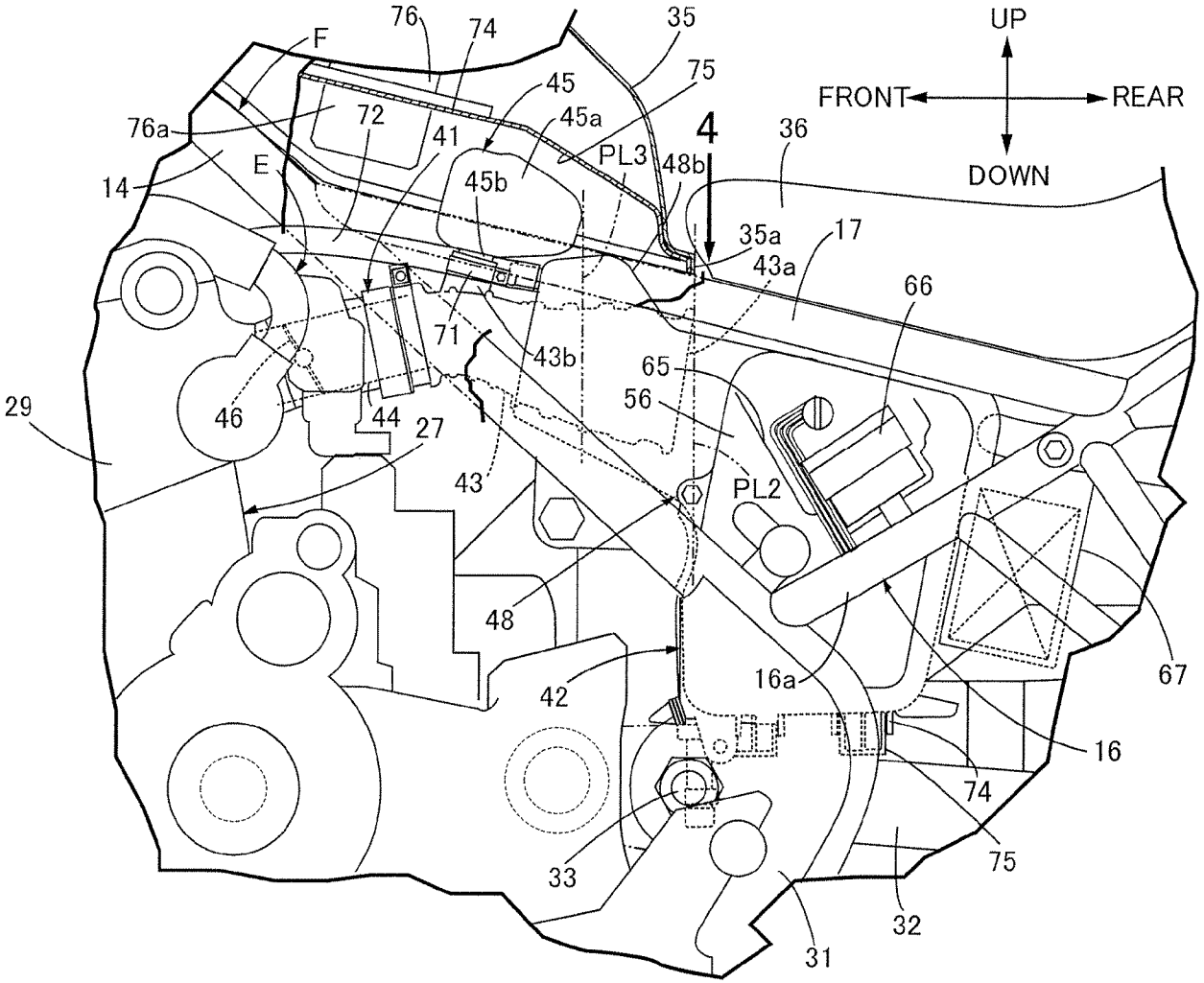
FIG. 3 is an enlarged view of a main portion in FIG. 1.
Figure 4:
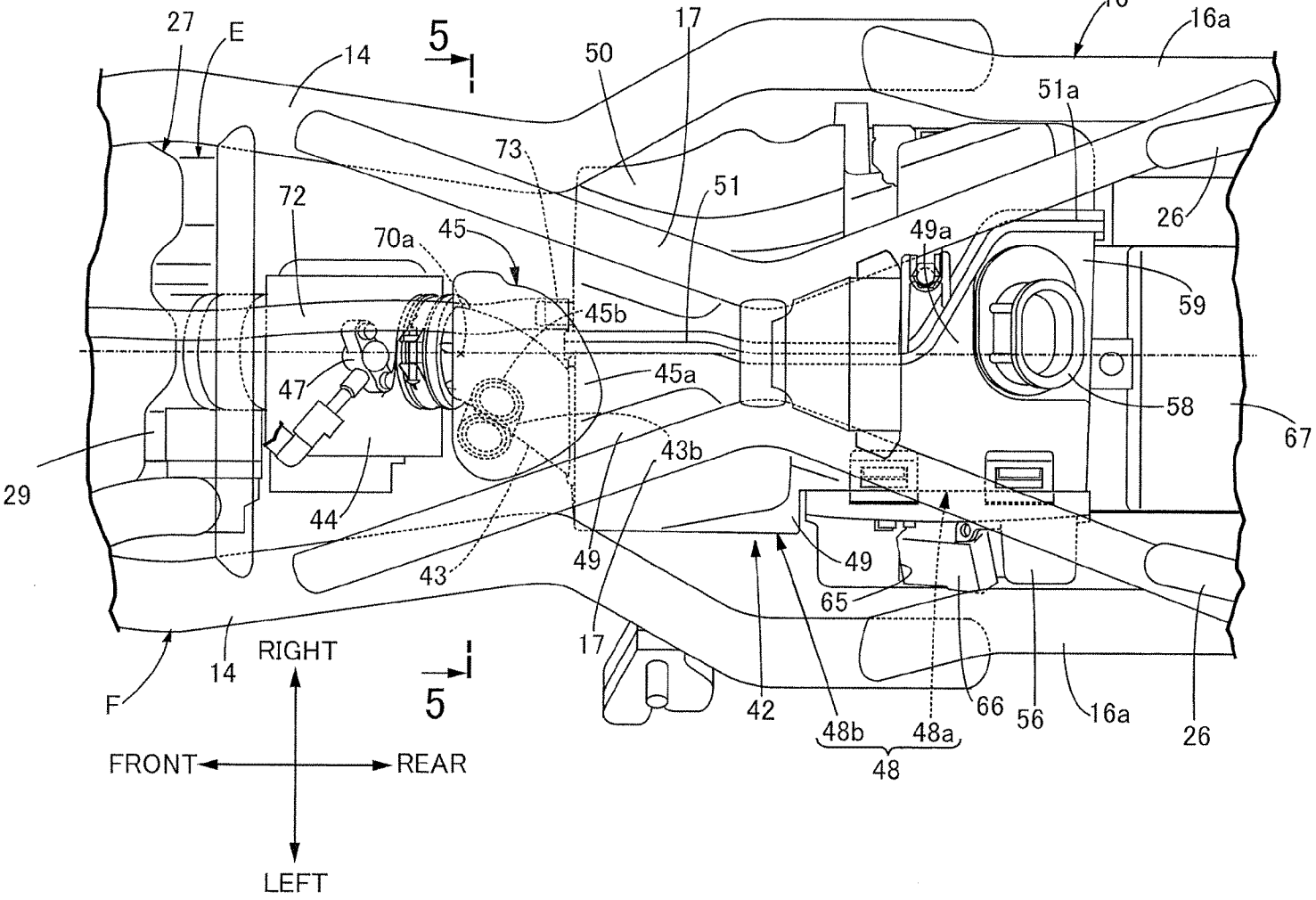
FIG. 4 is a view from arrow 4 in FIG. 3.

Referring to FIGS. 3 and 4 together, an engine body 27 of a single cylinder engine E equipped in the body frame F is supported by the main frames 14 and the down frames 15 of the body frame F. Further, in a bracket 31 formed in the lower portion of the main frame 14, a front end portion of a swing arm 32 pivotally supporting a rear wheel WR at a rear end portion thereof is swingably supported through a pivot 33 and a rear cushion unit 34 is arranged between the seat frame 16 and the swing arm 32. Further, a fuel tank 35 arranged above the engine body 27 is supported by the main frames 14 and a riding seat 36 on which an occupant rides is supported on the seat frame 16, the riding seat 36 being arranged in a rear portion of the fuel tank 35. Further, a rear fender 38 covering the rear wheel WR from above is attached to the pair of right and left rear frames 18 and a pillion seat 37 on which a pillion passenger rides is formed on the rear fender 38, the pillion seat 37 being arranged on a rear side of the riding seat 36.

An exhaust pipe 39, an upstream end of which is connected to a front side wall of a cylinder head 29 in the engine body 27, is extended rearward passing below the engine body 27 and connected to an exhaust muffler 40 arranged on the right side of the rear wheel WR.

An intake device 41 connected to the rear side wall of the cylinder head 29 includes an air cleaner 42, a connecting tube 43 an upstream end of which is connected to the air cleaner 42, a throttle body 44 as a throttle device having a throttle valve 46 and connected to the downstream end of the connecting tube 43, and a resonator 45. The air cleaner 42 is arranged on the rear side of the engine body 27 in the front-rear direction of the vehicle and a fuel injection valve 47 is attached to the throttle body 44 which is arranged in front of the air cleaner 42 and is connected to the rear side wall of the cylinder head 29.

The intake device 41 is arranged together with the engine body 27 at a position covered from the upper by the fuel tank 35. Further, the riding seat 36 on which the occupant rides is arranged on the rear side of the fuel tank 35 along the front-rear direction of the vehicle so as to cover the air cleaner 42 from above, the riding seat 36 being supported by the seat frame 16.

Figure 5:
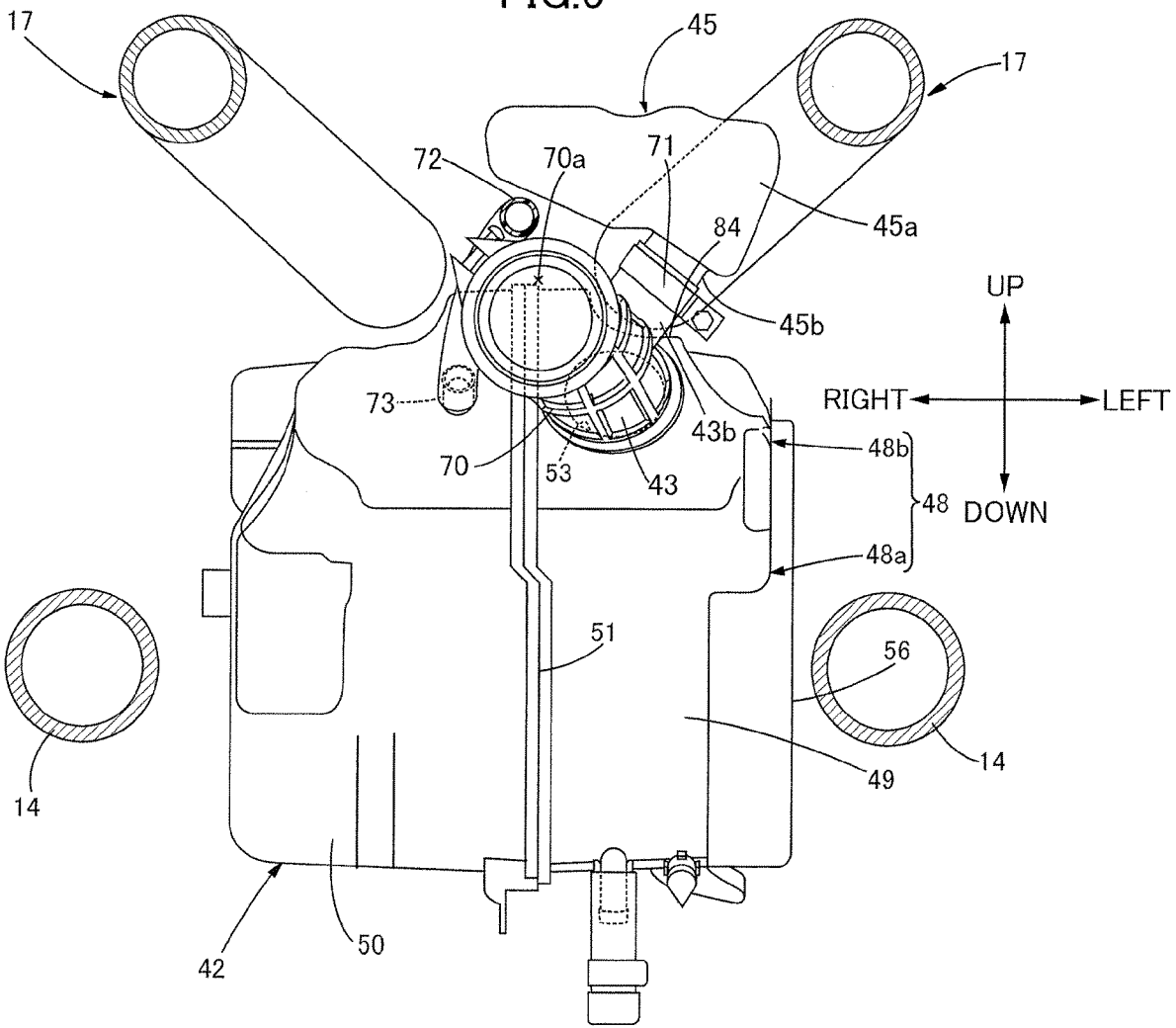
FIG. 5 is a sectional view along 5-5 line in FIG. 4.
Figure 6:
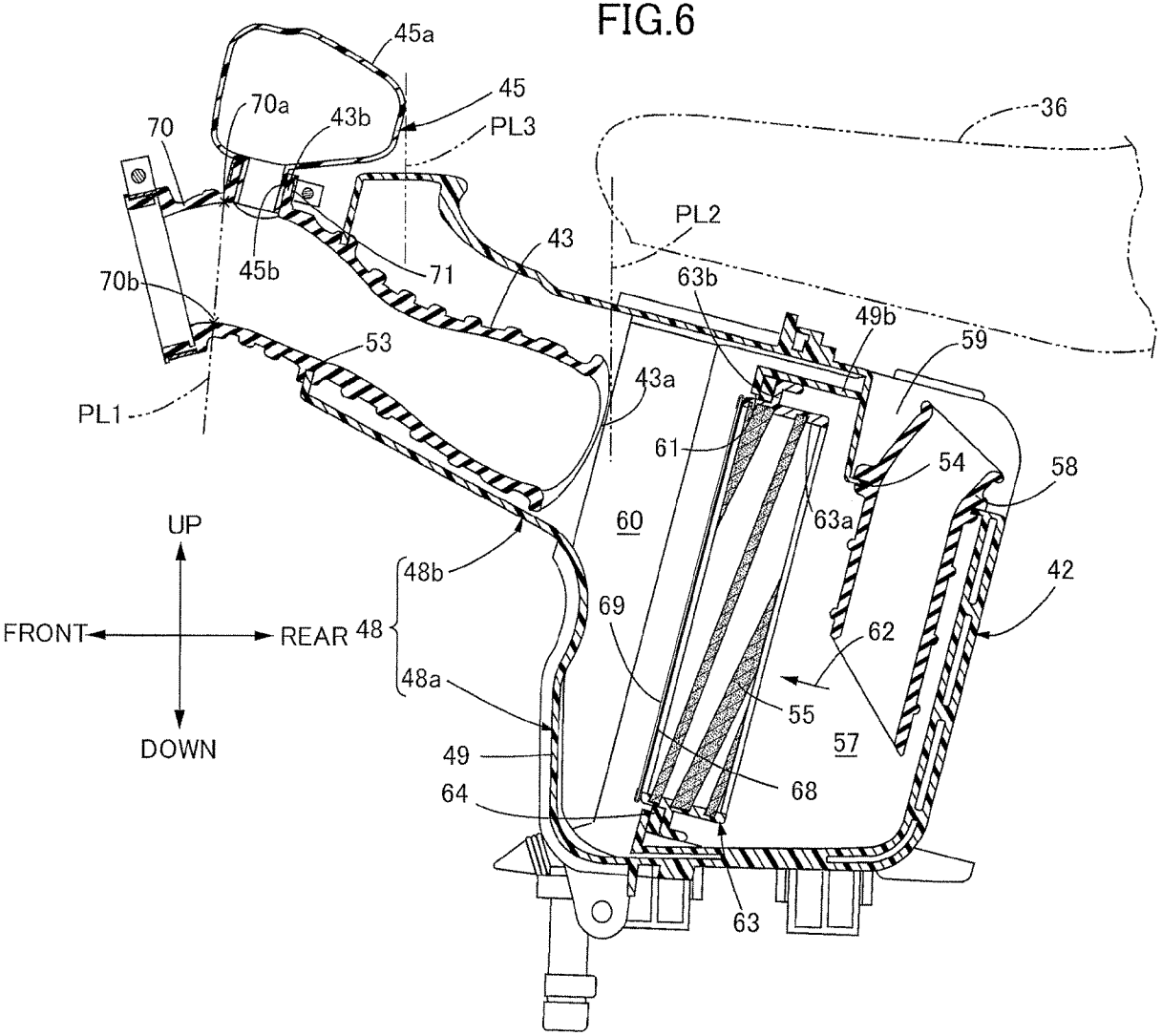
FIG. 6 is a longitudinal sectional view of an air cleaner.

Referring to FIGS. 5 and 6 together, a cleaner case 48 of the air cleaner 42 is constructed from first and second half cases 49, 50, which are made of synthetic resin and arranged in a vehicle width direction. Edge portions of the first half case 49 and the second half case 50 which face each other are connected to each other by friction joining so as to form the cleaner case 48. The cleaner case 48 is configured with:

a cleaner case main portion 48*a* with a rectangular box shape in which a cleaner element 55 is housed and arranged; and an extending portion 48*b* extended forward from the front upper portion, along the front-rear direction of the vehicle, of the cleaner case main portion 48*a*.

Although a connecting portion 51 of the first half case 49 and the second half case 50 basically exists along the front-rear direction of the vehicle, the rear potion of the connecting portion 51 is formed into a substantially L-shaped bending portion 51a as seen in a plan view and an enlarged portion 49*a* enlarged toward the second half case 50 side is formed in the first half case 49.

The first half case 49 of the first and second half cases 49, 50 is provided with a cleaner element inserting/detaching port (not shown), a purified air outlet 53, and an outer air suction opening 54. The cleaner element inserting/detaching port is opened to a left lateral side so as to be capable of inserting/detaching the cleaner element 55 in/from the cleaner case main portion 48*a*. The purified air outlet 53 is connected to the connecting tube 43. The outer air suction opening 54 introduce air from an outside into the cleaner case 48. A cover member 56 for shutting the cleaner element inserting/detaching port is removably attached to the left side surface of the first half case 49.

A non-purification chamber 57 arranged on the upstream side of the cleaner element 55 is formed in the first half case 49 at a position corresponding to the cleaner case main portion 48*a*. A part of the non-purification chamber 57 is formed in the enlarged portion 49*a* of the first half case 49.

On the upper surface of the rear portion, along the front-rear direction of the vehicle, of the enlarged portion 49*a* in the first half case 49, it is formed a recess portion 59 which is opened rearward and upward in the front-rear direction of the vehicle. On the bottom surface of the recess portion 59, the outer air suction opening 54 is formed. The intermediate portion in a longitudinal direction of an intake duct 58 for sucking air from the outside is connected to the outer air suction opening 54 so that one end of the intake duct 58 is entered in the non-purification chamber 57. The other end of the intake duct 58 is extended obliquely upward to the rear from the bottom surface of the recess portion 59 within the recess portion 59 so as not to protrude upward from the cleaner case 48 as seen in a side view.

The purified air outlet 53 is formed at the front end surface of the first half case 49 corresponding to the front end portion of the extending portion 48*b* along the front-rear direction of the vehicle. Further, within the cleaner case 48, it is formed a purification chamber 60 arranged on the downstream side of the cleaner element 55, and the intermediate portion in the longitudinal direction of the connecting tube 43 is connected to the purified air outlet 53 so that one end of the connecting tube 43 is entered in the purification chamber 60.

Paying attention for FIG. 6, an element supporting wall portion 49*b* is integrally provided to the first half case 49, the element supporting wall portion 49*b* supporting the peripheral edge portion of an element supporting frame 63 formed in the cleaner element 55. The element supporting wall portion 49*b* is provided with a rectangular opening 61 arranged between the non-purification chamber 57 and the purification chamber 60. The cleaner element 55 covering the opening 61 from the non-purification chamber 57 side is supported by the element supporting wall portion 49*b* so that a circulation direction 62 of air passing through the cleaner element 55 extends along the front-rear direction of the vehicle and the cleaner element 55 is arranged so as to be separated rearward in the front-rear direction of the vehicle from an upstream end 43*a* of the connecting tube 43.

The element supporting frame 63 is configured with a supporting tube portion 63*a* and a flange portion 63*b*. The supporting tube portion 63*a* is formed in a rectangular shape so that a part thereof is fitted in the opening 61, and the cleaner element 55 is housed and supported in the supporting tube portion 63*a*. The flange portion 63*b* is extended laterally from the supporting tube portion 63*a* so as to abut against the element supporting wall portion 49*b* on the non-purification chamber 57 side through an endless seal member 64.

The cleaner element 55 is covered with a metallic plate 68 and a mesh member 69 from the purification chamber 60 side. The plate 68 includes a plurality of circulation holes (not shown), and abuts against the end portion of the purification chamber 60 side of the supporting tube portion 63*a* in the element supporting frame 63. The mesh member 69 abuts against the plate 68 from the purification chamber 60 side. The plate 68 and the mesh member 69 are fixed to the supporting tube portion 63*a*.

On the outer surface of the cover member 56, a recess portion 65 recessed toward inner side is formed. An auxiliary machine for the vehicle, for example, a fuse box 66 is received and retained in the recess portion 65. Further, the cleaner case 48 is arranged on the front side, in the front-rear direction of the vehicle, of a battery box 67 equipped in the body frame F. The recess portion 59 formed in the rear portion of the cleaner case 48 is covered with the battery box 67 from the rear side.

The connecting tube 43 is formed so that a curved portion 70 exists at the intermediate portion in the longitudinal direction of the connecting tube 43. The curved portion 70 bulges upward and is curved in a chevron shape. The resonator 45 arranged between the fuel tank 35 and the connecting tube 43 is connected to the connecting tube 43 on the air cleaner 42 side further than a top portion 70*a* of the curved portion 70 as seen in the side view of the vehicle.

The resonator 45 is formed so as to integrally include a chamber portion 45*a* and a connecting pipe portion 45*b* continuous to the chamber portion 45*a*. On the other hand, on the air cleaner 42 side further than the top portion 70*a* of the curved portion 70 as seen in the side view of the vehicle, a connecting tube portion 43*b* is protruded integrally from the connecting tube 43. That is to say, the connecting pipe portion 43*b* is protruded integrally from the connecting tube 43 so that the connecting pipe portion 43*b* is opened in the inner surface of the upper portion of the connecting tube 43 on the air cleaner 42 side further than a first plane PL1 passing through the top portion 70*a*, and a lowermost portion 70*b* on the inner surface of the curved portion 70 of the connecting tube 43, as seen in the side view of the vehicle, the top portion 70*a* being an uppermost portion on the inner surface of the curved portion 70 of the connecting tube 43. The connecting pipe portion 43*b* and the connecting pipe portion 45*b* of the resonator 45 are fastened by a belt 71 in a state where the connecting pipe portion 45*b* of the resonator 45 is fitted to the connecting pipe portion 43*b*, thereby the resonator 45 is connected to the connecting tube 43.

In addition, the connecting portion of the resonator 45 to the connecting tube 43, that is, the connecting pipe portion 43*b* formed integrally with the connecting tube 43 is positioned on one (left side in this embodiment) of right and left sides of the top portion 70*a* of the curved portion 70 in the connecting tube 43 and the connecting pipe portion 43*b* is formed integrally with the connecting tube 43 so as to be obliquely inclined.

Meanwhile, an air hose 72 is extended from the cleaner case 48 in the air cleaner 42 so as to extend in the front-rear direction of the vehicle. The air hose 72 guides secondary air for purifying exhaust air. In this embodiment, the cleaner case 48 is configured with the first half case 49 and the second half case 50, a secondary air guide pipe 73 is provided integrally on a front end wall of the second half case 50, one end portion of the air hose 72 is connected to the secondary air guide pipe 73, and the air hose 72 is arranged so as to pass above the connecting tube 43 on the other (right side in this embodiment) of the right and left sides of the top portion 70*a* of the curved portion 70. A part of the chamber portion 45*a* of the resonator 45 is positioned at a position covering a part of the air hose 72 from above.

In the rear portion of a bottom plate 74 in the fuel tank 35, it is formed a recess portion 75 in which a part of the resonator 45 is received and the upstream end 43*a* of the connecting tube 43 is arranged within the cleaner case 48 of the air cleaner 42 so as to overlap with a rear end 35*a* of the fuel tank 35 as seen in the plan view. Namely, a second vertical plane PL2 extended in the vehicle width direction while passing through the rear end 35*a* of the fuel tank 35 passes through also the upstream end 43*a* of the connecting tube 43 within the cleaner case 48.

Further, the rear portion of the resonator 45 along the front-rear direction of the vehicle, that is, the rear portion of the chamber portion 45*a* is arranged so as to overlap with the front portion of the cleaner case 48 along the front-rear direction of the vehicle as seen in the plan view, and a third vertical plane PL3 extended in the vehicle width direction while passing through the rear end of the chamber portion 45*a* passes through the front portion of the cleaner case 48.

Further, to the bottom plate 74 of the fuel tank 35, a fuel pump 76 is attached so that a lower portion 76*a* of the fuel pump 76 is protruded downward from the bottom plate 74, and the resonator 45 is arranged on the rear side of the lower portion 76*a* of the fuel pump 76 in the front-rear direction of the vehicle as seen in the side view of the vehicle.

Next, an operation of the embodiment will be described hereinafter. The curved portion 70 bulged upward and curved in a chevron shape is formed in the connecting tube 43 and the resonator 45 arranged between the fuel tank 35 and the connecting tube 43 is connected to the connecting tube 43 on the air cleaner 42 side further than the top portion 70*a* of the curved portion 70 as seen in the side view of the body. Thereby, capacity of the resonator 45 can be secured while avoiding that the rear portion of the fuel tank 35 becomes high. Further, even when fuel, water or the like condensed within the resonator 45 drops on the connecting tube 43 side during non-use time of the vehicle after the engine E is stopped, such fuel, water or the like is flown to the air cleaner 42 side, thereby it can be prevented that fuel, water or the like invades into the throttle body 44.

Further, the recess portion 75 in which a part of the resonator 45 is received is formed in the rear portion of the bottom plate 74 in the fuel tank 35 and the upstream end of the connecting tube 43 is arranged within the cleaner case 48 of the air cleaner 42 so as to overlap with the rear end 35*a* of the fuel tank 35 as seen in the plan view. Therefore, height of the rear portion of the fuel tank 35 can be further lowered.

The rear portion of the resonator 45 along the front-rear direction of the vehicle is positioned so as to overlap with the front portion of the cleaner case 48 along the front-rear direction of the vehicle as seen in the plan view. Thus, by flattening the resonator 45, capacity of the resonator 45 can be secured while restraining that the rear portion of the fuel tank 35 becomes high.

Further, the fuel pump 76 is attached to the bottom plate 74 of the fuel tank 35 so that the lower portion 76*a* of the fuel pump 76 is protruded downward from the bottom plate 74 and the resonator 45 is arranged on the rear side of the lower portion 76*a* of the fuel pump 76 in the front-rear direction of the vehicle as seen in the side view of the vehicle. Thereby, the resonator 45 can be arranged while effectively utilizing a space around the lower portion 76*a* of the fuel pump 76.

Further, since the connecting portion of the resonator 45 to the connecting tube 43 is arranged on one of the right and left sides of the top portion 70*a* of the curved portion 70, path length between the resonator 45 and the connecting tube 43 can be secured while restraining that the rear position of the fuel tank 35 becomes high. In addition, the air hose 72 extended in the front-rear direction of the vehicle from the cleaner case 48 is arranged so as to pass above the connecting tube 43 on the other of the right and left sides of the top portion 70*a* of the curved portion 70. Thereby, the air hose 72 can be smoothly arranged.

Further, on the rear side of the fuel tank 35 along the front-rear direction of the vehicle, the riding seat 36 covering the air cleaner 42 from above is arranged, and the cleaner element 55 of the air cleaner 42 is arranged so as to be separated rearward in the front-rear direction of the vehicle from the upstream end 43*a* of the connecting tube 43 and so that the circulation direction 62 of air extends along the front-rear direction of the vehicle. Thereby, it is possible to contribute to reduction of seat height by restraining height of the air cleaner 42 while securing the space between the connecting tube 43 and the cleaner element 55.

Although the embodiment of the present invention is described above, the present invention is not limited to the above embodiment and various modifications and changes can be done without deviation from the gist of the present invention.

For example, although it is explained in the above embodiment a case that the throttle device is the throttle body 44, the present invention can be adopted for a case that the throttle device is a carburetor. Further, the present invention can be widely adopted for a saddle-ride type vehicle including a three-wheeled motor vehicle and the like in addition to the two-wheeled motor vehicle.

What is claimed is:

1. A saddle-ride vehicle in which a fuel tank and an engine body arranged in a lower side of the fuel tank are mounted to a body frame, and an intake device is arranged at a position covered by the fuel tank from above, the intake device including: an air cleaner; a connecting tube; a throttle device; and a resonator directly connected to the connecting tube, the connecting tube having an upstream end thereof directly connected to a purification chamber of the air cleaner and a downstream end thereof directly connected to the throttle device, the throttle device including a throttle valve, wherein a curved portion bulged upward and curved in a chevron shape is formed in the connecting tube, wherein the resonator is arranged between the fuel tank and the connecting tube and is connected to the connecting tube above a top most portion of the curved portion closer to an air cleaner side than the top most portion of the curved portion as seen in a side view of the vehicle, wherein the resonator is positioned above a downwardly curved section of the connecting tube, and wherein a connecting portion of the resonator to the connecting tube is arranged to extend upwardly of the connecting tube.

2. The saddle-ride vehicle according to claim 1, wherein the body frame comprises a pair of right and left main frames, and a pair of right and left seat sub-frames connected to intermediate portions of the pair of right and left main frames, respectively, and the resonator is placed between the pair of right and left seat sub-frames and is overlapped with the seat sub-frames as seen in the side view, wherein a recess portion receiving a part of the resonator is formed in a rear portion of a bottom plate in the fuel tank, and wherein the upstream end of the connecting tube is arranged in a cleaner case of the air cleaner so as to overlap with a rear end of the fuel tank as seen in a plan view.

3. The saddle-ride vehicle according to claim 2, wherein a rear portion of the resonator along a front-rear direction of the vehicle is arranged so as to overlap with a front portion of the cleaner case along the front-rear direction of the vehicle as seen in the plan view.

4. The saddle-ride vehicle according to claim 2, wherein a fuel pump is attached to the bottom plate of the fuel tank with a lower portion of the fuel pump being protruded downward from the bottom plate, and the resonator is arranged on a rear side of the lower portion of the fuel pump along the front-rear direction of the vehicle as seen in the side view of the vehicle.

5. The saddle-ride vehicle according to claim 2, wherein the connecting portion of the resonator to the connecting tube is arranged on one of right and left sides from the top portion of the curved portion, and an air hose extended in the front-rear direction of the vehicle from the cleaner case is arranged so as to pass above the connecting tube on an other of the right and left sides of the top portion of the curved portion.

6. The saddle-ride vehicle according to claims 3, wherein the connecting portion of the resonator to the connecting tube is arranged on one of right and left sides from the top portion of the curved portion, and an air hose extended in the front-rear direction of the vehicle from the cleaner case is arranged so as to pass above the connecting tube on an other of the right and left sides of the top portion of the curved portion.

7. The saddle-ride vehicle according to claim 4, wherein the connecting portion of the resonator to the connecting tube is arranged on one of right and left sides from the top portion of the curved portion, and an air hose extended in the front-rear direction of the vehicle from the cleaner case is arranged so as to pass above the connecting tube on an other of the right and left sides of the top portion of the curved portion.

8. The saddle-ride vehicle according to claim 2, wherein a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

9. The saddle-ride vehicle according to claim 3, wherein a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

10. The saddle-ride vehicle according to claim 4, wherein a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

11. The saddle-ride vehicle according to claim 5, wherein a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

12. The saddle-ride vehicle according to claim 6, wherein a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

13. The saddle-ride vehicle according to claim 7, wherein a riding seat covering the air cleaner from above is arranged on a rear side of the fuel tank along the front-rear direction of the vehicle, and a cleaner element of the air cleaner is arranged so as to be separated rearward in the front-rear direction of the vehicle from the upstream end of the connecting tube and so that a circulation direction of air extends along the front-rear direction of the vehicle.

14. The saddle-ride vehicle according to claim 3, wherein a fuel pump is attached to the bottom plate of the fuel tank with a lower portion of the fuel pump being protruded downward from the bottom plate, and the resonator is arranged on a rear side of the lower portion of the fuel pump along the front-rear direction of the vehicle as seen in the side view of the vehicle.

15. The saddle-ride vehicle according to claim 1, wherein the connecting portion of the resonator to the connecting tube is arranged on one of right and left sides from the top portion of the curved portion and inclined obliquely upwardly, and the resonator extends toward the other of right and left sides.

16. The saddle-ride vehicle according to claim 2, wherein an air hose is arranged between the resonator and the connecting tube.

* * * * *